US006779433B2

(12) United States Patent
Brosch et al.

(10) Patent No.: US 6,779,433 B2
(45) Date of Patent: Aug. 24, 2004

(54) AXIAL PISTON ENGINE

(75) Inventors: Werner Brosch, Nersingen (DE); Raimund Roth, Nersingen (DE)

(73) Assignee: Brueninghaus Hydromatik GmbH, Elchingen (DE)

( * ) Notice: Subject to any disclaimer, the term of this patent is extended or adjusted under 35 U.S.C. 154(b) by 55 days.

(21) Appl. No.: 10/275,629

(22) PCT Filed: Mar. 15, 2001

(86) PCT No.: PCT/EP01/02950

§ 371 (c)(1),
(2), (4) Date: Nov. 6, 2002

(87) PCT Pub. No.: WO01/98656

PCT Pub. Date: Dec. 27, 2001

(65) Prior Publication Data

US 2003/0136359 A1 Jul. 24, 2003

(30) Foreign Application Priority Data

Jun. 20, 2000 (DE) ..... 100 30 147

(51) Int. Cl.[7] ..... F01B 25/26
(52) U.S. Cl. ..... 92/5 R; 92/57; 91/1
(58) Field of Search ..... 92/5 R, 57; 91/1; 60/328

(56) References Cited

U.S. PATENT DOCUMENTS

| | | | | |
|---|---|---|---|---|
| 4,655,689 A | | 4/1987 | Westveer et al. | |
| 5,135,031 A | * | 8/1992 | Burgess et al. | 91/361 |
| 5,545,013 A | * | 8/1996 | Beck et al. | 417/201 |
| 6,279,452 B1 | * | 8/2001 | Moya | 92/57 |

FOREIGN PATENT DOCUMENTS

| | | |
|---|---|---|
| DE | 0 94 08 860 U | 9/1994 |
| EP | 0 419 984 A2 | 4/1991 |
| EP | 0 640 183 | 3/1995 |
| JP | 62-201366 | 9/1987 |

* cited by examiner

*Primary Examiner*—Edward K. Look
*Assistant Examiner*—Michael Leslie
(74) *Attorney, Agent, or Firm*—Scully, Scott, Murphy & Presser

(57) ABSTRACT

The invention relates to an axial piston engine (1) with a housing (2), inside the housing interior (4) of which a drive shaft (7) and a cylinder drum (16), arranged axially adjacent to said shaft, are rotatably mounted. The longitudinal mid-axes (9*a*, 9*b*) of the driveshaft (7) and the cylinder drum (17) run inclined to each other at an angle (W). Several piston bores (18) are arranged in he cylinder drum (16), running roughly parallel to the mid-axis thereof and in which pistons (21) may run axially up and down. The ends of said pistons, facing the driveshaft (7), are universally pivoted.

10 Claims, 3 Drawing Sheets

AXIAL PISTON ENGINE

BACKGROUND OF THE INVENTION

1. Field of the Invention

The invention relates to an axial piston engine according to the preamble of claim 1 or 2.

2. Discussion of the Prior Art

An axial piston engine according to the preamble of claim 1 is described in DE 94 088 60 U1. In said previously known axial piston engine, which is of the inclined-axis design, on the circumference of the driving flange a counting rim is formed in such a way that, viewed in cross section, it has the same radial extension at each point of its circumference and therefore generates low churning losses. The counting rim cooperates with a sensor, which is fastenable in the radial plane of the counting rim to the housing.

An axial piston engine according to the preamble of claim 2 is described in an inclined-axis design in EP 0 640 183 B1. In said previously known axial piston engine, the pistons at their ends facing the drive shaft have spherical heads, by which they are pivotally supported in spherical caps of the drive shaft. For the sake of simplicity, a return apparatus is not illustrated in said axial piston engine. The drive shaft at its inner end is designed as a flange, on which are disposed delivery elements in different developments for the fluid disposed in the housing interior of the axial piston engine. According to FIGS. 1 and 2 of said document, the delivery elements are formed by blades, which protrude approximately radially from the circumference of the driving flange forming a body of rotation and are fastened to a radially extending fastening flange, which is fastened by means of screws to the side of the driving flange facing the cylinder drum. According to FIGS. 4 and 5 of said document, radially extending blades acting as a centrifugal pump are provided, which are disposed between the driving flange and the cylinder drum and may either be assembled into a blade wheel or formed in each case integrally with a vertically protruding fastening plate and fastened via the latter by means of fastening screws to the free end face of the driving flange facing the cylinder drum. The blades form pumping devices, by means of which during functional operation of the axial piston engine fluid disposed in the latter's housing interior is delivered to an outlet opening, which lies radially opposite the blades in the peripheral wall of the housing and is connected to a tank.

SUMMARY OF THE INVENTION

The underlying object of the invention is to simplify an axial piston engine according to the preamble of claim 1 or 2. In particular, easy and rapid manufacture is to be achieved, with the result that it is preferably also to be possible to reduce the cost of manufacture.

Said object is achieved by the features of claim 1 or 2. Advantageous developments of the invention are described in the sub-claims.

In both solutions according to the invention, in each case an essential feature of the refinement according to the invention, namely on the one hand the marking and on the other hand the delivery elements, is formed on the return disk. The return disk is a component, on which the relevant features of the invention may be prefabricated easily and rapidly, so that it may in the course of its manufacture be prefabricated with the refinement according to the invention and other parts of the axial piston engine may remain unchanged or additional components, such as are necessary in the prior art, may no longer apply.

Because of the omission of additional components, with the refinements according to the invention assembly and/or disassembly is also simplified. In said case, it is particularly advantageous to form the features according to the invention integrally on the body of rotation. This may be effected advantageously by punching and optionally also shaping and/or bending. The refinements according to the invention therefore also enable advantageous manufacture.

BRIEF DESCRIPTION OF THE DRAWINGS

There now follows a description of the invention by way of advantageous refinements of several embodiments. The drawings show.

DETAILED DESCRIPTION OF THE INVENTIONS

Figure 1:
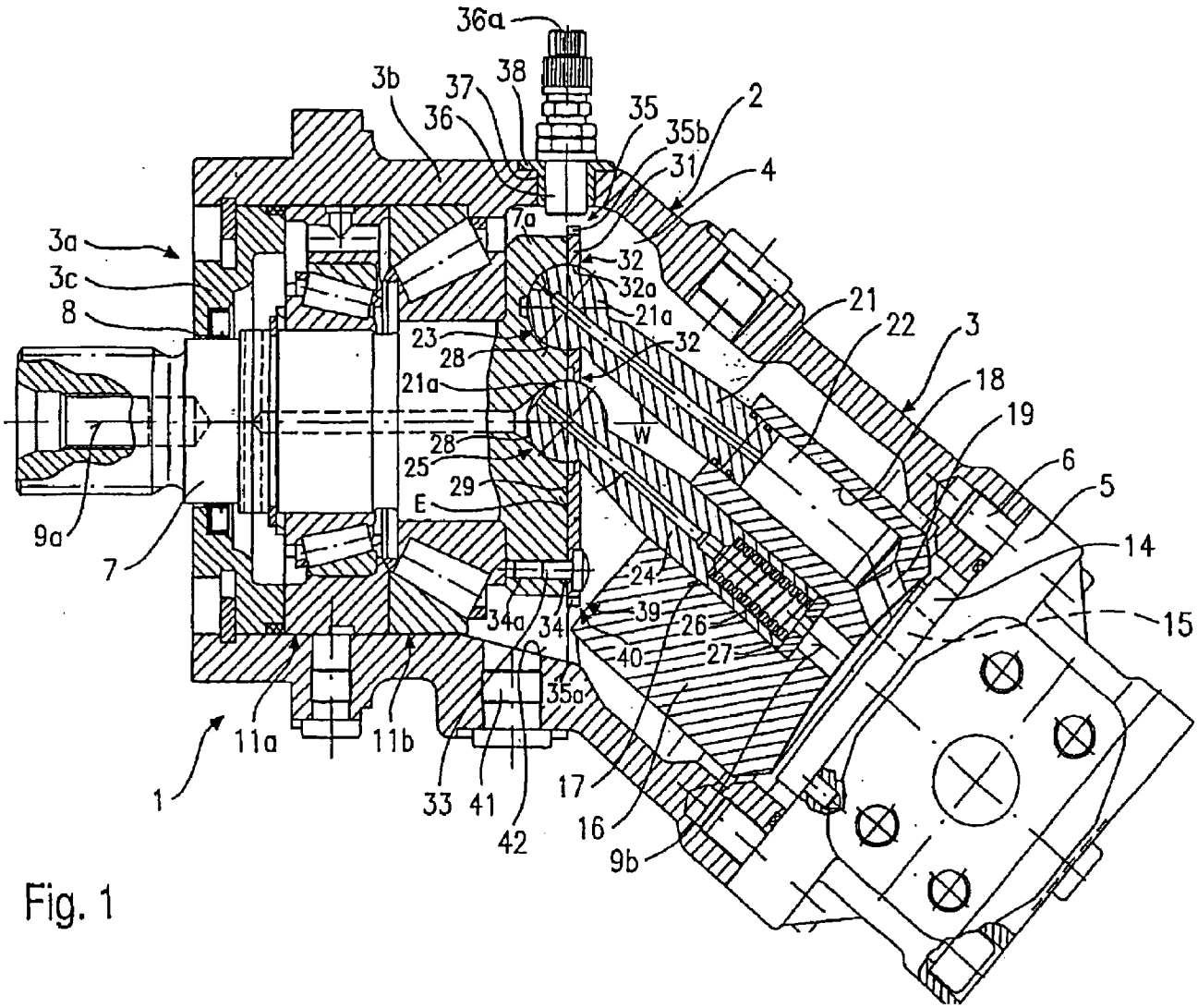
FIG. 1 an axial piston-engine according to the invention in axial section.
Figure 2:
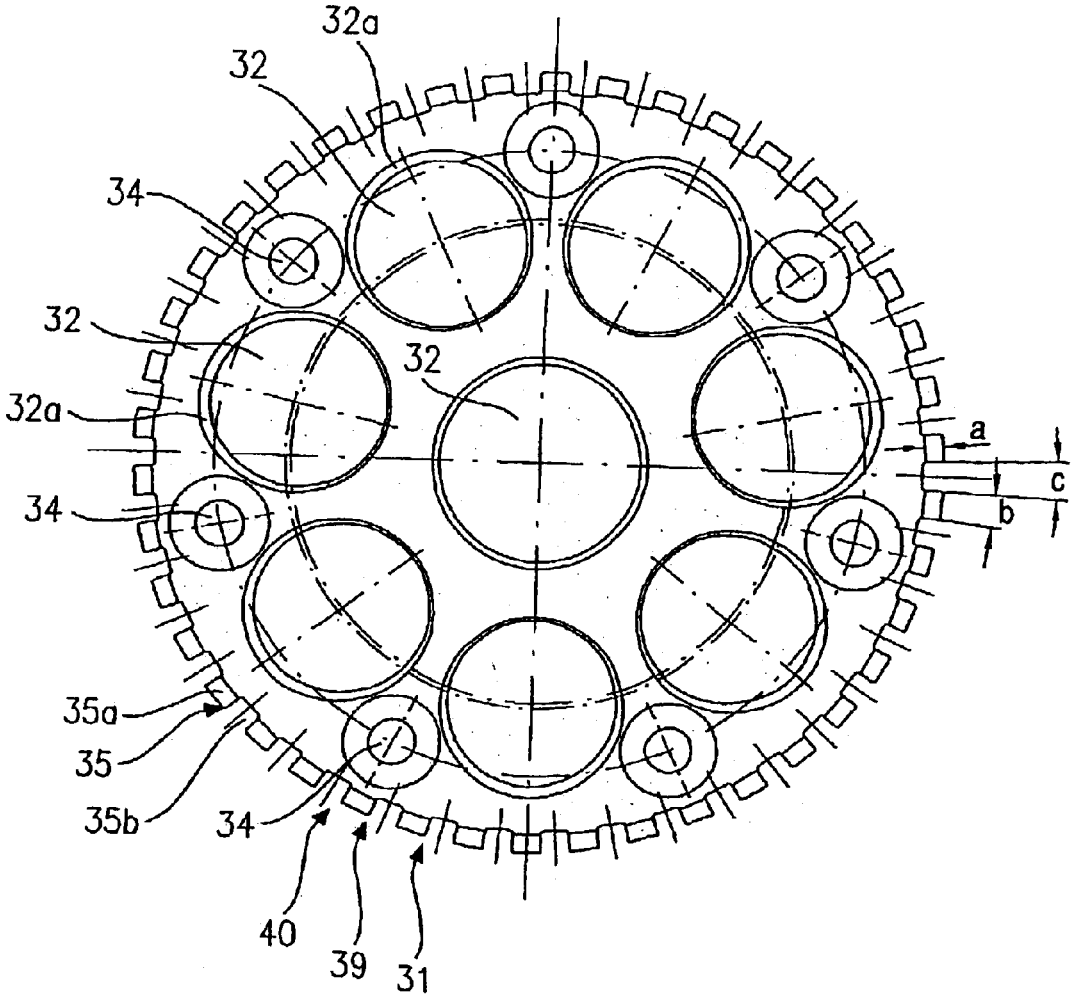
FIG. 2 the front view of a return disk.

The axial piston engines 1 illustrated by way of example are of an inclined-axis design. They comprise a closed housing 2, having a pot-shaped housing part 3, the housing interior 4 of which is detachably closed by means of a so-called connecting part 5, which is screw-fastened by screws 6 (implied in the drawings) to the free edge of the housing part 3. Mounted rotatably in the housing 2 is a drive shaft 7, which penetrates the base wall 3*a* of the pot-shaped housing 3 in a feedthrough hole 8. Particularly in the case of an inclined-axis engine of variable throughput volume, the pot-shaped housing part 3 is kinked in the region of its peripheral wall 3*b*, so that the longitudinal centre lines 9*a*, 9*b* of the housing part portions, which are bent or kinked relative to one another, include an acute angle W. The drive shaft 7 is disposed in the base-side housing part portion and supported therein by means of at least one rolling-contact bearing. The base wall 3*a* may be formed in that a sealing washer 3*c* is inserted in a sealed manner into the peripheral wall 3*b* and axially fixed, wherein the drive shaft 7 penetrates the feedthrough hole 8 of said sealing washer with motional clearance and is sealed therein by means of a sealing ring. In the present embodiment, for rotatably supporting the drive shaft 7 two axially juxtaposed rolling-contact bearings 11*a*, 11*b* are provided, which are seated in a corresponding bearing bore in the region of the peripheral wall 3*b* of the base-side housing part portion.

Lying against the inside of the connecting part 5 is a cam disk 14 having two control channels 15, which lie diametrically opposite one another and extend approximately parallel to the centre line 9*b* of the cam disk 14 and are connected in each case to a supply line and a discharge line in the connecting part 5. Lying against the inside of the cam disk 14 is a cylinder drum 16, which has a coaxial guide bore 17 and a plurality of approximately paraxially extending piston bores 18, which are disposed so as to be distributed over the circumference and are connected at their ends facing the control channels 15 by tapered supply and discharge channels 19 to the control channels 15. The guide bore 17 and the piston bores 18 open out at the end of the cylinder drum 16 remote from the cam disk 14.

Pistons 21 are supported in the piston bores 18 so as to be displaceable axially to and fro, preferably also so as to be capable of slight oscillation, and with their ends facing the cam disk 14 delimit working chambers 22 in the piston bores 18 and with their head ends remote from the cam disk 14 project from the cylinder drum 16 and are connected by means of supporting joints 23, in particular ball joints, in a universally pivoted manner to the drive shaft 7. The supporting joints 23 are situated in a bearing plane E, which extends at right angles to the centre line portion 9*a* and which, because of the housing part portions being disposed at an acute angle to one another, is inclined relative to the centre line portion 9*b*. In a comparable manner to the pistons 21, a central journal 24 is constructed and connected by a supporting joint 25 pivotally to the drive shaft 7 and extends into the guide bore 17 and is supported with slight motional clearance therein so as to be displaceable axially to and fro. Disposed between the central journal 24 and the cylinder drum 16 is a compression spring 26, in particular a cylindrical helical spring, which biases the cylinder drum 16 with a specific axial force towards the cam disk 14. In the illustrated embodiment, the compression spring 26 is disposed in an open-ended bore in the central journal 24, is supported against the base of the bore and acts against an inner shoulder surface 27 of the cylinder drum 16.

In the present embodiment, the supporting joints 23 for the pistons, 21 and preferably also the supporting joint 25 for the central journal 24 are formed in each case by a hemispherical cup 28 in the inner, preferably flat end face 29 of the drive shaft 7 and by a return disk 31, common to all of the pistons 21, which engages behind the spherical piston ends and hence prevents removal of the latter from the cups 28. The return disk 31 has an arrangement of return bores 32, which correspond in number and position to the cups 28 and the edges of which engage behind the associated spherical head 21*a*, thereby positively preventing the latter from moving out of the cup 28. In principle, for said purpose it is sufficient when the hole edges engage behind the spherical heads 21*a*, since they are smaller than the diameter and/or equator of the spherical heads 21*a*. In order during functional operation to keep friction and wear low, it is advantageous to design the bore wall surface 32*a* of each of the return bores 32 either in the shape of a cone, such that they lie tangentially against the associated spherical head 21*a*, or in the shape of a spherical segment, such that the bore wall surface 32*a* lies flat against the spherical surface of the associated spherical head 21*a*. In the former case, line contact arises between the spherical head 21*a* and the bore wall surface 32*a*. In the latter case, surface contact arises between said two surfaces. The supporting bearing 25 for the central journal 24 may be of a corresponding design comprising a cup 28 in the drive shaft 7 and a return bore 32 in the return disk 31.

The return disk 31 is detachably fastened, preferably screw-fastened, to the drive shaft 7. For said purpose, a plurality of cap screws 33 may be used, which penetrate paraxial feedthrough holes 34 in the return disk 31 and are screwed into corresponding tapped holes 34*a* in the drive shaft 7.

Formed on the circumference of the return disk 31, which preferably takes the form of a thin parallel disk, is a toothed rim 35 having teeth 35*a* and tooth spaces 35*b* of equal size in their peripheral direction. Fastened to the housing 2 at a slight, preferably radial distance from the toothed rim 35 is a sensor 36, which during rotary operation of the axial piston engine 1, because of the differences caused by the teeth 35*a* and tooth spaces 35*b* moving past it, generates signals which are used in a non-illustrated signal processing apparatus to measure the rotational speed. Such a sensor 36 is known as such and requires no further description. The signals may be generated e.g. by virtue of the detection of magnetic field variations, which arise when the teeth 35*a* and tooth spaces 35*b* penetrate a magnetic field associated with the sensor. It is therefore advantageous to manufacture the return disk 31 from metal, in particular steel, or alloyed steel. The sensor may alternatively comprise a light-sensitive element, which detects the shadows caused by the teeth 35*a*.

The sensor 36 is preferably disposed in the housing interior 4, wherein in the present embodiment it penetrates the peripheral wall 3*b* from outside in a feedthrough hole 37 and is e.g. plugged or screwed in, preferably in a bush 38 screwed into the peripheral wall 3*b*. The sensor 36 is connected by an electric line 36*a* to an associated electronic control device. In the context of the invention, instead of the toothed rim 35 markings 39 of any kind may be provided, to which the sensor 36 reacts for the supply of signals. In the case of a light-sensitive sensor 36, light-dark contrast markings 39, for example, may be provided.

Figure 3:
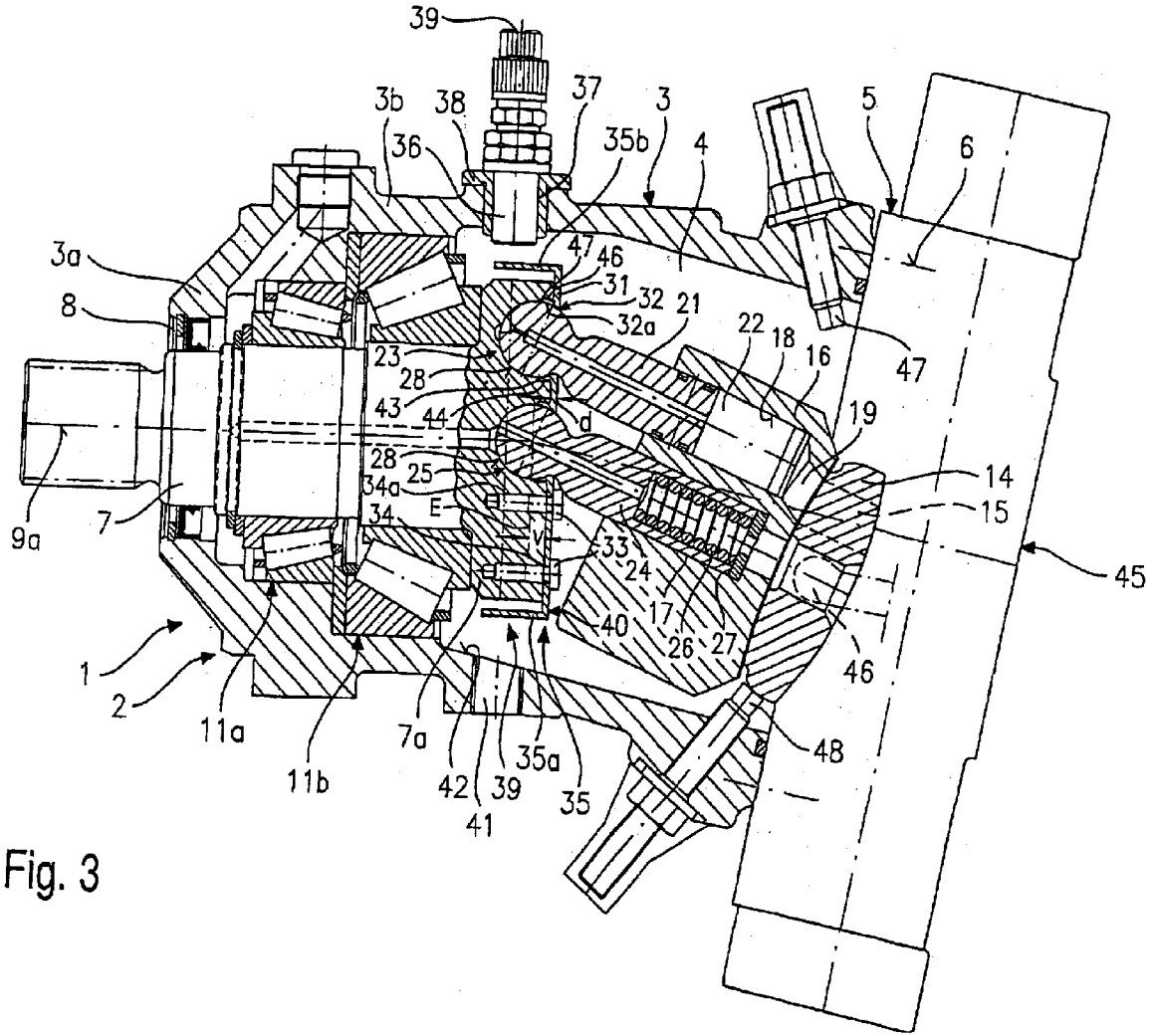
FIG. 3 an axial piston engine according to the invention in axial section in a modified refinement.

In the embodiment according to FIG. 3, in which identical or comparable parts are provided with identical reference characters, the teeth 35*a* extend paraxially, wherein they may be correspondingly bent round. In said case, the radial dimension a of the teeth 35*a* may be smaller than the dimension b extending in peripheral direction. The dimension c, in peripheral direction, of the tooth spaces 35*b* may correspond to the dimension b. In order to achieve a low overall axial length and not affect the spatial region occupied by the cylinder drum 16, it is advantageous for the teeth 35*a* according to FIG. 3 to extend in the axial direction remote from the cylinder drum 16, wherein they may be at a radial distance from the circumference of the drive shaft 7.

As the cross-sectional size of the drive shaft 7 may be smaller than the cross-sectional size taken up by the cups 28, it is advantageous to provide the drive shaft 7 at its inner end facing the cylinder drum 16 with a flange 7*a*, in which the cups 28 and/or supporting joints 23 are formed.

When the markings 39 are formed by shaped parts, it is advantageous to form said shaped parts integrally on the return disk 31, as is possible in the case of a toothed rim 35. It is further advantageous to form the teeth 35*a* integrally on the return disk 31 through punching. In said case, the return disk 31 as a whole may be manufactured by punching, e.g. by punching out a suitable blank, in particular by punching a metal plate. In said case, the teeth may be bent and the bore edges of the return bores 32 may be embossed and/or deformed by compression.

It is advantageous for the fluid of the axial piston engine 1 situated in the housing interior 4 to be circulated preferably continuously. To said end, the previously described shaped parts and/or teeth 35*a* may be used as delivery elements 40, wherein they deliver the fluid to an outlet opening 41 in the peripheral wall 3*b* and through a line (not shown) extending from the outlet opening 41 to a tank. In view of said aspect, it is advantageous for the delivery elements, which also form markings 39 and/or teeth 35*a*, to be formed by blades, which improve the delivery rate. Given such a refinement, in which the teeth 35*a* form delivery elements of a delivery device, it is advantageous to make the annular space provided between the delivery elements 40 and the peripheral wall 3*b* larger in the region of the outlet opening 41 than in the remaining region and/or to enlarge said annular space continuously towards the outlet opening 41. Such an enlargement is achievable with a low constructional outlay particularly when the outlet opening 41 is disposed at the side, towards which the cylinder drum 16 and the housing part portion surrounding the latter are inclined. In said case, the annular space enlargement may be utilized by means of the inclination of a suitably inclined peripheral wall portion, which is denoted by 42.

When the bearing plane E extends on the end face of the drive shaft 7, a considerable thickness of the return disk 31 is needed to achieve reliable engagement behind the piston heads 21*a*. In the embodiment according to FIG. 3, the bearing plane E is offset relative to the end face by the offset dimension v into the drive shaft 7. The bore surfaces 32*a* are formed on preferably segment- or ring-shaped bearing projections 43, which protrude from the bore edge of the return bores 32 towards the drive shaft 7 and project into corresponding widened portions 44 of the cups 28, which extend approximately as far as the equator of the cup 28. The bearing projections 43 are preferably integral mouldings. They may be edge regions of an associated spherical head 21*a*, which are suitably bent round into the axially protruding shape and/or deformed by compression. Said refinement enables a small dimension for the thickness d of the return disk 31, e.g. smaller than the axial length of the bearing projections 43. In said case also, the return disk 31 is preferably a punched part and/or a punched/bent part, and/or a punched/shaped part.

In the embodiment according to FIG. 1, the axial piston engine 1 is not variable in terms of its throughput volume. It is a so-called fixed displacement engine. In the embodiment according to FIG. 3, the throughput volume of the axial piston engine may be reduced and/or increased. For said purpose, an as such known adjusting apparatus generally denoted by 45 is used, which comprises an adjusting element 46, which is in working connection e.g. with the cam disk 14 and by means of which the cylinder drum 16 is adjustable between a minimum position and a maximum position and preferably also settable into intermediate positions. The minimum and maximum positions are delimited by lateral stops 47, 48, which may be formed by setting screws, which penetrate the peripheral wall 3*b*.

What is claimed is:

1. Axial piston engine (1) having a housing (2), in the housing interior (4) of which a drive shaft (7) and, axially next to the latter, a cylinder drum (16) are rotatably supported, wherein the longitudinal center lines (9*a*, 9*b*) of the drive shaft (7) and of the cylinder drum (17) are inclined at an angle (W) relative to one another, wherein in the cylinder drum (16) a plurality of piston bores (18) extending approximately parallel to its center line (9*b*) are disposed, in which pistons (21) are guided so as to be displaceable axially to and fro, of which the piston ends facing the drive shaft (7) are connected in a universally pivotal manner by supporting joints (25) to the drive shaft (7), wherein a return disk (31) common to all supporting joints (23) is provided, which prevents axial removal of the piston ends from the supporting joints (23), and wherein a sensor (36) for determining the rotational speed of the drive shaft (7) is provided, which cooperates with markings (39) disposed so as to be distributed in peripheral direction on a component, which during functional operation rotates with the drive shaft (7), characterised in that the markings (39) are disposed in the peripheral region of the return disk (31).

2. Axial piston engine (1) having a housing (2), in the housing interior (4) of which a drive shaft (7) and, axially next to the latter, a cylinder drum (16) are rotatably supported, wherein the longitudinal center lines (9*a*, 9*b*) of the drive shaft (7) and of the cylinder drum (17) are inclined at an angle (W) relative to one another, wherein in the cylinder drum (16) a plurality of piston bores (18) extending approximately parallel to its center line (9*b*) are disposed, in which pistons (21) are guided so as to be displaceable axially to and fro, of which the piston ends facing the drive shaft (7) are connected in a universally pivotal manner by supporting joints (25) to the drive shaft (7), wherein a return disk (31) common to all supporting joints (23) is provided, which prevents axial removal of the piston ends from the supporting joints (23), and wherein delivery elements (40) for delivering the fluid situated in the housing interior (4) are disposed so as to be distributed in peripheral direction on a component, which during functional operation rotates with in the drive shaft (7), characterised in that the delivery elements (40) are disposed in the circumferential region of the return disk (31).

3. Axial piston engine according to claim 1, characterised in that the markings (39) are formed by delivery elements (4) or teeth (35*a*) of a toothed rim (35).

4. Axial piston engine according to claim 2, characterised in that the delivery elements (40) are formed by a toothed rim (35).

5. Axial piston engine according to one of claims 3 or 4, characterised in that the delivery elements (40) or teeth (35*a*) protrude radially or axially from the return disk (31).

6. Axial piston engine according to claim 5, characterised in that the delivery elements (40) or teeth (35*a*) are formed integrally on the return disk (31) by punching.

7. Axial piston engine according to claim 5, characterised in that the delivery elements (40) or teeth (35*a*) are disposed on the circumference of the return disk (31) and are bent round axially.

8. Axial piston engine according to claim 3, characterised in that the sensor (36) is disposed in the housing interior (4), and extends from the outside inwards through a feedthrough hole (37) in the housing (2).

9. Axial piston engine according to claim 8, characterised in that in the region of the housing (2) adjacent to the delivery elements (40) or teeth (35*a*) is disposed an outlet bole (41) which is sealable by a sealing part comprising a screw plug.

10. Axial piston engine according to claim 9, characterised in that the outlet hole (41) is situated in a wall region (42) of the housing (2) delimiting an annular space between the delivery elements (40) or teeth (35*a*) and the housing (2), the size of which annular space increases in peripheral direction towards the outlet hole (41).

* * * * *